United States Patent [19]

Stewart

[11] 4,156,343

[45] May 29, 1979

[54] POWER GENERATING ASSEMBLY

[76] Inventor: Robert C. Stewart, Box 374, Rte. 5, Spokane, Wash. 99208

[21] Appl. No.: 848,873

[22] Filed: Nov. 7, 1977

[51] Int. Cl.[2] ..... F01K 25/00

[52] U.S. Cl. ..... 60/671; 60/676; 60/690

[58] Field of Search ..... 60/651, 653, 671, 676, 60/690

[56] References Cited

FOREIGN PATENT DOCUMENTS 483282 6/1917 France ..... 60/671

*Primary Examiner*—Gerald A. Michalsky

*Attorney, Agent, or Firm*—William C. Babcock

[57] ABSTRACT

A power generating assembly in which a portion of the heat energy in a stream of fluid such as warm or hot air is extracted and transformed to rotary power as a body of low boiling liquid is recirculated through a closed path. Vapor of the liquid liquifies when subjected to a pressure greater than a first pressure and a temperature lower than a first temperature. The vapor is superheated by the heat energy above-identified to a high pressure at which it actuates a reciprocating mechanism to produce rotary power. Vapor discharging from the reciprocating mechanism is allowed to expand adiabatically in a first confined space, and be cooled. A compressor draws vapor from the first confined space and discharges the same into a second confined space at a pressure greater than the first pressure. The temperature of the vapor in the second confined space is lowered below that of the first temperature whereupon the vapor assumes the liquid form. The liquid discharges sequentially through an expansion valve into a pre-heater in the second confined space to transform to vapor. The heat necessary for the vaporization of liquid in the pre-heater is withdrawn from the vapor in the second confined space, and this withdrawn heat lowering the temperature of the vapor in the second confined space below the first temperature. Vapor flows from the pre-heater to a boiler where it is super heated to a desired high pressure prior to discharge to the reciprocating mechanism. Heat for the boiler is from the stream of fluid previously identified.

8 Claims, 10 Drawing Figures

9

POWER GENERATING ASSEMBLY

BACKGROUND OF THE INVENTION

1. Field of the Invention

Power Generating Assembly.

2. Description of the Prior Art

In all areas of the world vast and inexhaustible quantities of a fluid exist such as warm or hot air and liquid in the form of lakes and rivers exist that have a substantial heat energy content. The desirability of using such heat energy that is available at low cost to produce rotational power will readily be apparent.

However, prior to the present invention no assembly has been available to achieve this result.

A primary object of the present invention is to supply an assembly in which a fixed quantity of a low boiling point liquid is sequentially transformed to high pressure vapor, low pressure vapor, low pressure liquid and high pressure liquid as it recirculates through a closed path to actuate a rotary power producing mechanism by the use of a compressor and heat from fluid such as a stream of warm or hot air, or water from a lake, river or a well.

SUMMARY OF THE INVENTION

The power generating assembly includes a boiler through which a current of fluid that has a substantial heat content circulates, the fluid being warm or hot air, river, lake or well water or the like. The fluid is at a temperature substantially higher than the boiling point of the volatile liquid that is the working medium employed in the assembly.

The fluid after flowing through the boiler flows through a liquid receiver, and is then returned to the source thereof. The liquid receiver is connected to a succession of valves that sequentially open to permit the volatile liquid to flow by gravity from an expansion tank.

Vapor of the liquid liquifies when the vapor is subjected to a temperature less than a first temperature and a pressure greater than a first pressure. The temperature of fluid in the boiler is substantially higher than the first temperature.

Liquid accumulates in the expansion tank due to vapor in the tank being withdrawn therefrom and compressed to a pressure higher than the first pressure. The withdrawn vapor due to the compression is heated and is subsequently discharged into a compression tank. The compression tank has a pre-heater coil therein that is in communication with an expansion valve that receives heated liquid from the receiver tank.

The heated liquid as it discharges from the expansion valve assumes the vapor state, and the heat of vaporization for this transformation being absorbed from vapor in the condenser. The loss of heat from vapor in the condenser results in the temperature thereof dropping below the first temperature and liquifying as a result thereof. The liquid flows by gravity to the expansion tank where it subsequently flows through the succession of valves to the liquid receiver tank. The vapor flows from the pre-heater to the boiler where it is superheated to have a desired pressure.

The superheated vapor discharges from the boiler to a rotary power producing device that may be either of the structure illustrated in FIG. 1 of the drawings or the device disclosed and claimed in my U.S. Pat. No. 4,003,136 entitled "Vapor Actuated Power Generating Device" that issued July 5, 1977. The vapor after actuating the rotary power generating device exhausts therefrom to expand adiabatically in the expansion tank and have the temperature thereof lowered as a result of this expansion.

The power generating device is illustrated in FIG. 9 as driving an electrical generator, which generator when operating produces heat. The heat so produced would normally be wasted, but in the present invention is used to super heat a portion of the vapor that is discharged to the rotary power producing device.

From the above description it will be seen that the power producing device is indirectly actuated by solar energy. Solar energy heats the ambient atmosphere and the water in lakes and rivers, and any one of these sources may supply the heated fluid necessary in the operation of the present invention.

DESCRIPTION OF THE PREFERRED EMBODIMENT

Figures 9, 10:
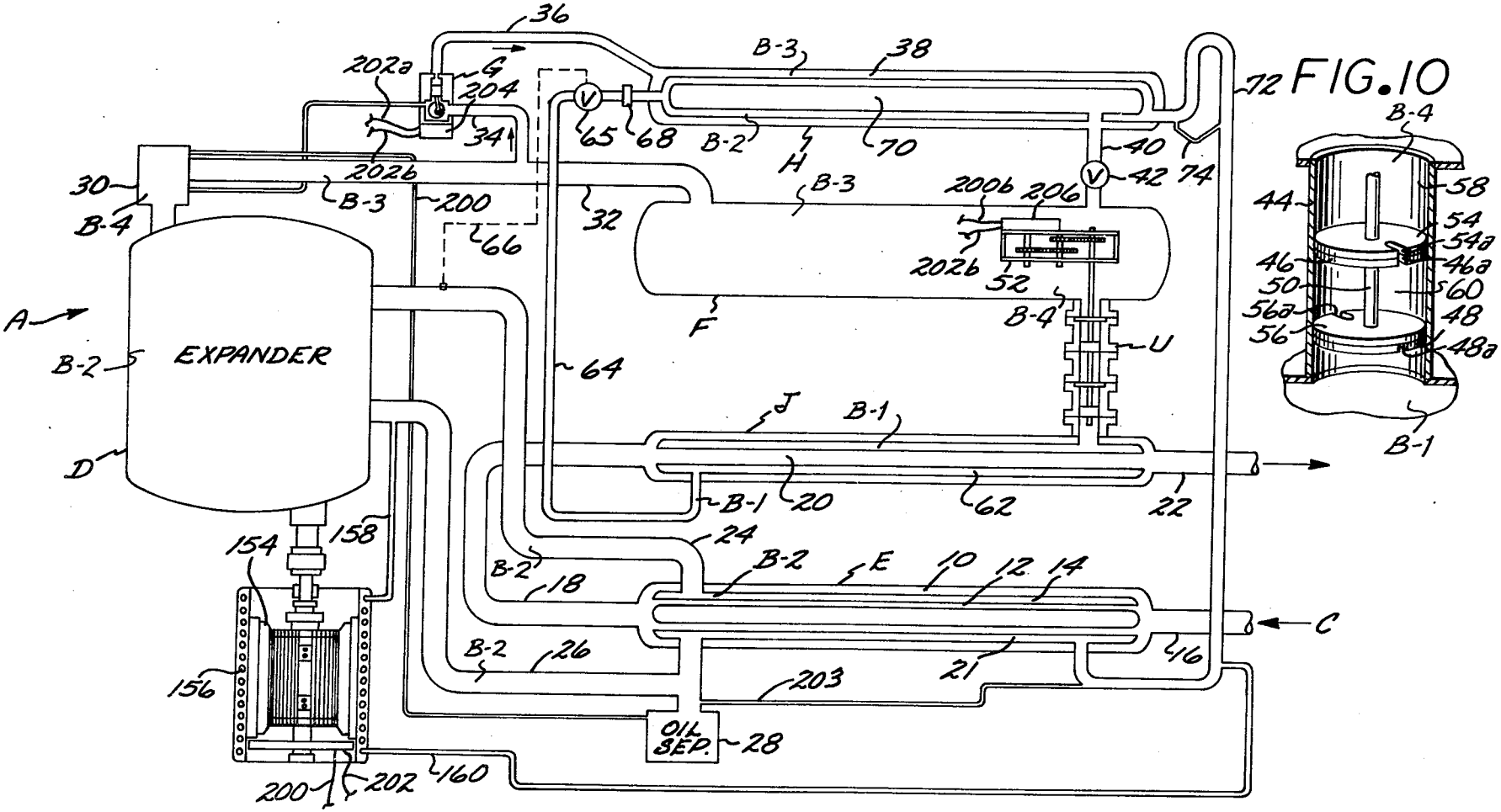
FIG. 9 is a diagrammatic view of the rotary power generating assembly.
FIG. 10 is a fragmentary transverse cross-sectional view of a portion of the power generating device shown in FIG. 1.

The rotary power generating assembly A shown in FIG. 9 employs a volatile liquid B, such as liquid carbon dioxide, one of the freons, or the like as the working medium. The liquid B has a vapor that returns to the liquid state when subjected to a pressure in excess to a pressure P, and a temperature below a temperature T. The liquid B boils at ambient pressure above a temperature T-1.

Heat energy for actuating the power generating assembly A is supplied from a fluid C that is at a temperature T-2 that is substantially higher than the temperature T-1. The fluid C may be any readily available fluid that occurs in nature such as warm or hot air, or water from a stream, river, lake, ocean or a well, or the like.

The rotary power generating assembly as may best be seen in FIG. 9 includes a boiler E, expansion tank F, power driven compressor G, condenser tank H, liquid receiving tank J, and a rotary power generating mechanism D. The components above-described are all interconnected in such a manner as to provide a closed path through which the volatile liquid B is sequentially recycled and in so doing actuating the rotary power generating mechanism D. The volatile liquid B that serves as the working medium will due to heat supplied by the fluid C and pressure supplied by the compressor G sequentially transform between liquid and vapor as it moves through the closed path previously identified. The liquid B in flowing through the closed path will exist as the high pressure liquid B-1, high pressure vapor B-2, low pressure vapor B-3, and low pressure liquid B-4.

The boiler E as can be seen in FIG. 9 is illustrated as including an outer elongate shell 10, an inner shell 12 that is separated from the outer shell 10 and defines a space 14 therebetween that is connected to a conduit 16 that extends to a source of the fluid C. Fluid C after flowing longitudinally through the space 14 of boiler E enters a conduit 18 that conducts the fluid to a confined passage 20 that extends longitudinally through the liquid receiver tank J, and this passage being connected to a conduit 22 that returns the fluid C to the source thereof or a desired disposal area. High pressure vapor B-2 is heated in a space 21 in the boiler E, and the vapor in a super heated condition flowing through a conduit 24 to the power generating mechanism D, and cool vapor flowing out of the mechanism D through a conduit 26 to return to the boiler B for reheating. The conduit 26 is in communication with an oil separator as shown in FIG. 9. Low pressure liquid B-4 discharges from the power producing mechanism D into a housing 30 from which a conduit 32 extends to the interior of the expansion tank F.

A power driven compressor G withdraws low pressure vapor B-3 from the expansion tank F through a conduit 34 and discharges the vapor at a pressure greater than the pressure P into a conduit 36 that is in communication with a confined space 38 defined within the condenser tank H. The confined space 38 is in communication with a downwardly extending conduit 40 that has a valve 42 therein, with the conduit 40 being in communication with the interior of the expansion tank F. The lower interior of the expansion tank F is in communication with a downwardly extending valve assembly U.

The valve assembly U includes a cylindrical housing 44 that has first and second vertically spaced transversely positioned first and second plates 46 and 48 disposed therein as shown in FIG. 10 with each of these plates having an opening 46*a* and 48*a* respectively formed therein. The first and second plates rotatably and sealingly support a centered vertically extending shaft 50 that may be slowly rotated by a motor actuated mechanism 52. First and second circular valve members 54 and 56 are secured to the shaft 50 and rotate in sliding contact with the first and second plates 46 and 48. The first and second valve members 54 and 56 as may be seen in FIG. 10 have first and second openings 54*a* and 56*a* therein that sequentially align with the openings 46*a* and 48*a*. Low pressure liquid B-4 may flow from the expansion tank F into a first confined space 58 situated above the first valve member 54 and will so remain until the openings 54*a* and 46*a* are in radial alignment as shown in FIG. 10, with the liquid then flowing from the first confined space 58 by gravity into a second confined space 60. As the shaft 50 continues to rotate the openings 46*a* and 54*a* are moved out of registry, and subsequently the openings 48*a* and 56*a* are brought into radial alignment to permit the liquid that has entered the confined space 60 to discharge downwardly therefrom by gravity through the openings 48*a* and 56*a* into the interior 62 of the liquid receiver tank J. Due to the sequential operation of the valve assembly U, liquid B may flow from the expansion tank F to the receiver tank J, with but a minimum of vapor accompanying such flow.

The heating of liquid B in the space 62 of the liquid receiver J transforms the same into high pressure liquid B-1 that flows therefrom through a conduit 64 to a pressure controlled valve 65 that opens and closes in response to the pressure within the power producing device D by means of a sensor 66 that is connected to the conduit 24. When the valve 65 opens high pressure liquid B-1 may flow therethrough to discharge through an expansion valve 68 into a preheater 70 situated within the condenser tank H, the high pressure liquid B-1 by entering the preheater 70 expands to high pressure vapor B-2, and the heat of vaporization required for this expansion being extracted from liquid B-3 in space 38, and the low pressure vapor B-3 as a result of this loss of heat being transformed to low pressure liquid B-4 that flows to the interior of the expansion tank F when the valve 42 is in an open position. The high pressure vapor B-2 in the pre-heater 70 is pre-heated due to absorption of heat from the low pressure liquid B-4 in the confined space 38. The pre-heated high pressure vapor B-2 flows from the pre-heater 70 through a conduit 72 to the boiler E to be super heated and discharge in that form through the conduit 24 to the power generating device D.

Figure 2:
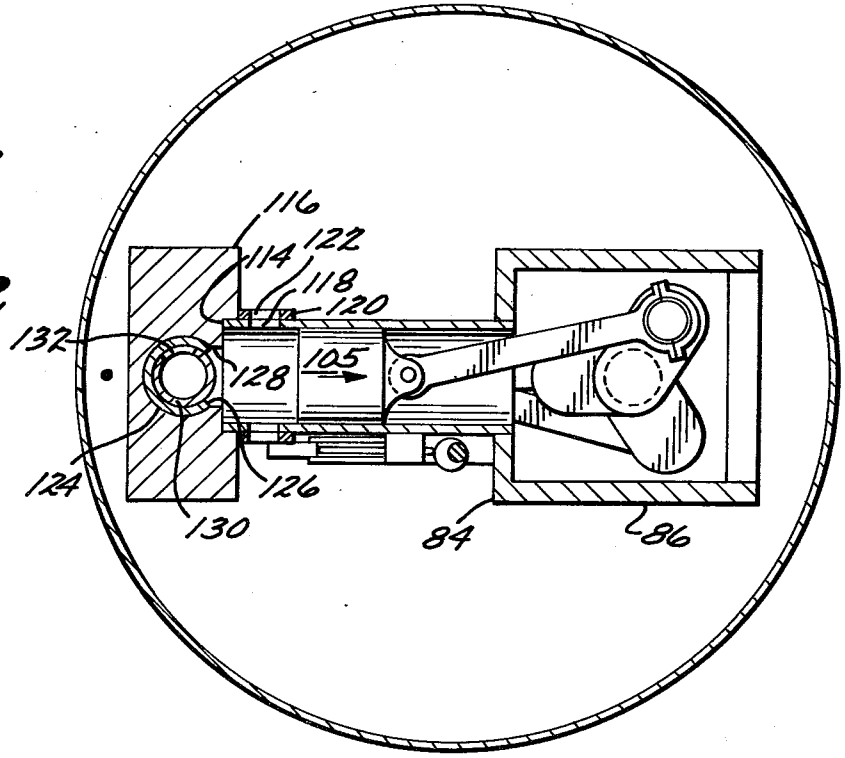
FIG. 2 is a transverse cross-sectional view of the device shown in FIG. 1 taken on the line 2—2 thereof.
Figure 1:
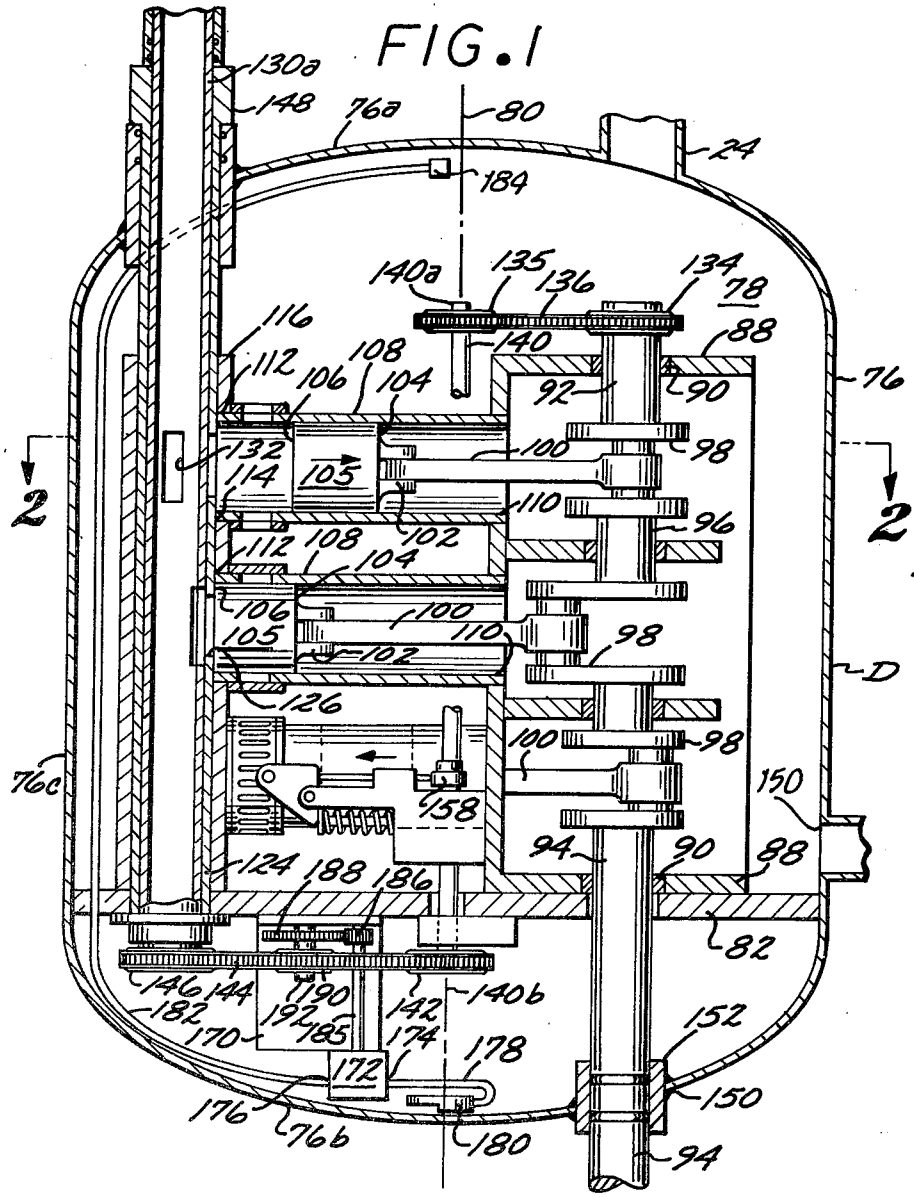
FIG. 1 is a combined transverse cross-sectional and side elevational view of the rotary power producing device.

The vaporized pressure actuated power generating mechanism D as may best be seen in FIG. 1 includes an elongate pressure vessel 76 that defines a confined space 78 within the interior thereof, and the pressure vessel being so disposed that the longitudinal axis 80 thereof is substantially vertical. The pressure vessel has an upwardly disposed end 76*a* and a downwardly disposed end 76*b* as may be seen in FIG. 1. A cylindrical side wall 76*c* extends between the upwardly and downwardly disposed ends 76*a* and 76*b*. A transverse horizontal platform 82 is supported from the interior surface of the side wall 76 adjacent the downwardly disposed end 76*b* of the pressure vessel 76. The platform 82 supports an upwardly extending framework 84 within the confined space 78, which framework includes an elongate box 86 that has end pieces 88 that support axially aligned journals 90. First and second end portions 92 and 94 of a crankshaft 96 are rotatably supported in the journals 90.

The crankshaft 96 includes at least one throw that is pivotally engaged by one end of a connecting rod 100, and the opposite end of the connecting rod being pivotally secured by conventional means 102 to a first end surface 104 of a cylindrical piston 105, which piston has a second end 106. Each piston is slidably mounted in a cylinder 108 supported from the framework 84, with each cylinder having a first open end 110 and a second open end 112. Each second open end of a cylinder 108 is disposed in a recess 114 formed in a vertically extending member 116 as best seen in FIG. 1.

Each cylinder 108 as may best be seen in FIGS. 3 to 6 inclusive, has a series of circumferentially spaced first ports 118 formed therein adjacent the second open end of the cylinder. Each cylinder has a ring-shaped valve member 120 mounted on the exterior portion thereof to overly the first port. Each ring-shaped valve member 120 has a series of circumferentially spaced second ports 122 formed therein, which second ports may be brought into registry with the first ports 118 when the valve member is rotated from the first position shown in FIG. 4 to the second position illustrated in FIG. 6.

A first elongate tube 124 is disposed within the member 116, with the first tube having a number of longitudinally spaced first openings 126 formed therein that are axially aligned with first passages 128 that at all times communicate with the second open ends of the cylinders 108.

An elongate tubular valve member 130 is rotatably and sealingly mounted within the first tube 124 as best seen in FIG. 1, with the tubular member having a number of longitudinally spaced second openings 132 therein that are not longitudinally aligned with one another. When the tubular valve member 130 is rotated the second openings 132 are successively brought into communication with the first openings associated therewith.

A first sprocket 134 is secured to the first end portion 92 of the crankshaft 96 and this first sprocket engaging an endless chain 136 that extends to a second sprocket 138 mounted on a first end portion **140*a* of a shaft 140. Shaft 140 is rotatably supported in the framework 84 parallel to the main bearings of the crankshaft 96 as shown in FIG. 1. A second end portion 140*b* of the shaft 140 has a third sprocket 142 secured thereto that engages an endless belt 144 that extends to a fourth sprocket 146 secured to an end portion of the tubular valve member 130. The upper end portion 130*a* of the tubular valve member 130 is rotatably and sealingly mounted in a tubular assembly 148 that communicates with the interior of the housing 30. The pressure vessel 76 above the platform 82 has an opening 150 therein through which cooled high pressure vapor B-2 may return through conduit 26 to the boiler E to be super heated and then discharged through the conduit 24 to the upper interior portion of the vessel 76. The pressure vessel 76 has an opening 150 in the lower end 76*b* thereof in which a sealed journal 152 is disposed that rotatably supports the lower end portion 94 of the crankshaft 96. The end portion 94 as can be seen in FIG. 9 is connected to an electric generator 154 that has a tubular coil 156** extending thereabout.

When the generator 154 is driven by rotation of the crankshaft 96, heat radiates from the generator. The coil 156 has one end connected by a conduit 158 to the conduit 26, and the other end of the coil being connected to a conduit 160 that extends to the conduit 72. The vaporized liquid B discharges from the conduit 26 not only into the interior of a pressure vessel 76 but also into the conduit 158 where it flows through the coil 176 to be heated by radiation from the electric generator 154 and this heated liquid being returned by the conduit 160 to the conduit 72. Thus, the heat eminating from the generator 154 that would normally be lost is employed in heating the fluid B prior to the latter being discharged through the conduit 26 to the interior confined space 78 within the pressure vessel 76.

Figure 3:
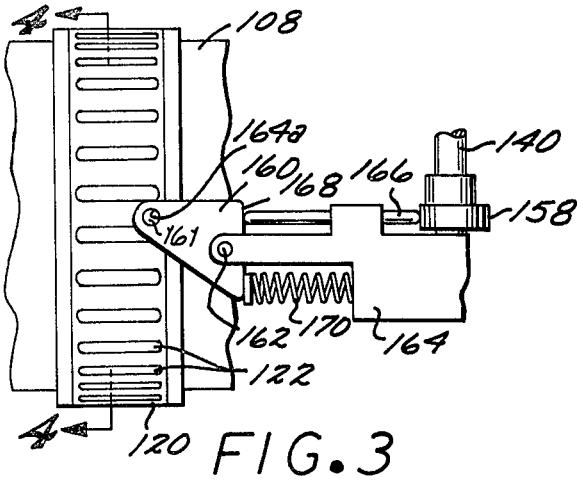
FIG. 3 is a side elevational view of an end portion of a cylinder that has a ported ring-shaped valve member thereon that is rotatably moved by a cam operated actuator.
Figure 4:
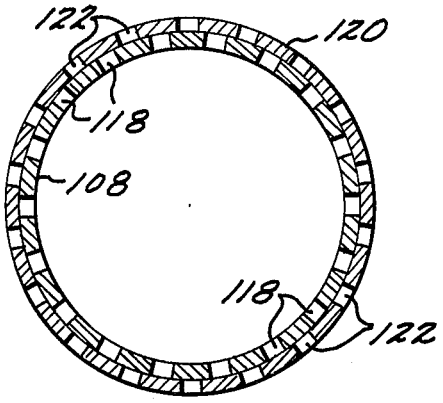
FIG. 4 is a transverse cross-sectional view of the cylinder and valve member shown in FIG. 3 taken on the line 4—4 thereof, and with the valve member in a first position in which ports in the valve member and cylinder are out of registry.
Figure 5:
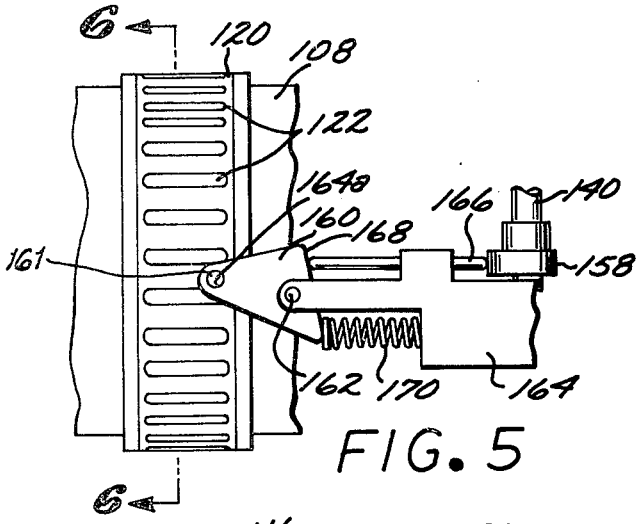
FIG. 5 is the same view as shown in FIG. 3 but with the actuator having moved the ring-shaped valve member to a second position.
Figure 6:
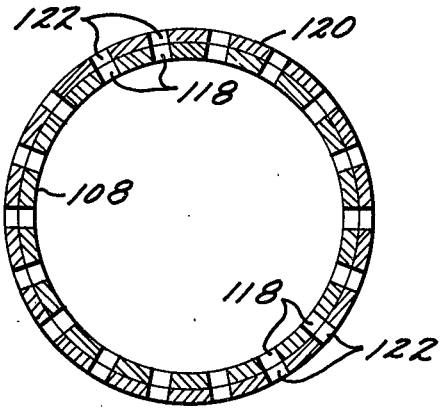
FIG. 6 is a transverse cross-sectional view of the cylinder and ring-shaped member taken on the line 6—6 of FIG. 5, with the valve member in a second position in which ports therein and in the cylinder are in registry.
Figure 7:
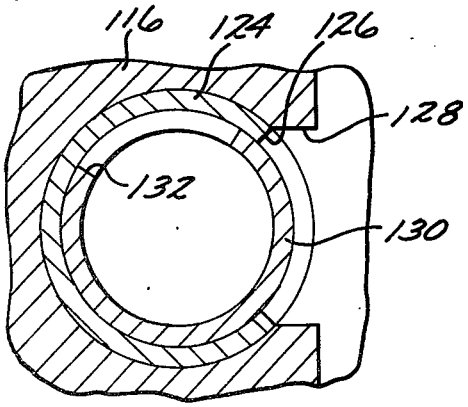
FIGS. 7 and 8 are transverse cross-sectional views of the tubular valve member in first and second positions.
Figure 8:
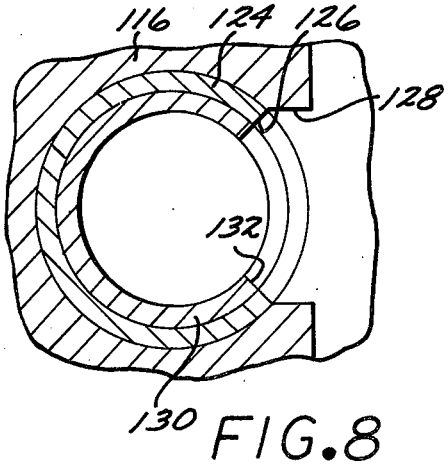

A number of cams 158 are mounted on the shaft 140 and serve to operate actuators 159, each of which actuators sequentially move one of the ring-shaped valve members 120 between the first and second positions shown in FIGS. 4 and 6. Each actuator as may be seen in FIGS. 3 and 5 includes a first pin 161 that extends outwardly from one of the ring-shaped valve members 120 to engage an opening **164*a* formed in the apex portion of a triangular shaped member 164. Each member 160 is pivotally supported by a second pin 162 from a bracket 164 secured to the framework 84. Each bracket 164 slidably supports a rod 166 that bears against the cam 158 associated therewith and a side 168 of the member 160. A compressed helical spring 170 is in abutting contact with the bracket 164 and side 168 and at all times tends to maintain the member 160 in a first position as shown in FIG. 3. The member 160 when in the first position also maintains the valve member 120 associated therewith in the first position as shown in FIG. 4 where the first and second ports 118 and 122** are out of registry.

In FIG. 1 it will be seen that a bracket 170 extends downwardly from the platform 82, which bracket supports an oil pump 172 that has an intake 174 and discharge 176. Intake 174 is connected by a tube 178 to an oil strainer 180 located adjacent lower shell end portion **76*b*. Discharge 176 is connected by a tube 182 that extends to a spray nozzle 184 located adjacent the upper end portion 76*a* of vessel 76. Pump 172 has a drive shaft 185 extending therefrom that has a pinion gear 186 secured thereto that engages a gear 188. The gear 188 is secured to a gear 190 that is mounted on a stub shaft 192 that depends from platform 82. The gear 190 engages belt 144 and is driven as the belt rotates. As drive shaft 185 is driven the pump 172 discharges oil 194 from the nozzle 184** as a spray over the moving components of the invention situated therebelow.

Initiation of operation of the rotating power generating assembly A is achieved by first causing fluid C to sequentially flow through the boiler E and the liquid collector J. Valve 65 is now placed in an open position to allow high pressure liquid B-1 to discharge from the expansion orifice 68 into the preheater 70. The high pressure liquid B-1 expands in the preheater 70 and transforms to high pressure vapor B-2 that flows through conduit 72 to boiler E to discharge therefrom as superheated high pressure vapor.

The super heated high pressure vapor flows into the confined space 78. When one of the pistons 105 is moving to the right as illustrated in the uppermost piston in FIG. 1, the actuator 160 associated with that piston is holding the valve member 120 in the second position illustrated in FIGS. 5 and 6. The high pressure vapor in space 78 exerts equal and opposite forces on the first and second end surfaces 104 and 106 of the piston. The only work energy required in moving the piston to the right as above described is that work energy necessary to overcome the friction as the piston 105 slides in the associated cylinder 108.

After a piston 105 has reached dead center at the right hand end of a cylinder 108 and starts to move to the left as viewed in FIG. 1, the actuator 160 associated with that piston moves the ring-shaped valve member on that piston to the first position shown in FIGS. 3 and 4. Concurrently the second opening 132 in tubular valve member 130 has been brought into communication with first opening 126 and the interior of the cylinder 108 associated with that piston.

High pressure vapor B-2 that had entered the cylinder when the piston 105 was moving to the right now flows from the cylinder 108 into the tubular valve member 130, and in so doing expands. The heat required for such expansion is withdrawn from heated high pressure vapor B-2 in confined space 78, and the vapor is cooled as a result thereof. Cooled high pressure vapor flows from confined space 78 through conduit 26 to return to boiler E to be reheated. The vapor discharged into tubular valve member 130 flows longitudinally therethrough to housing 30, and from the housing through conduit 32 to expansion tank F where further expansion takes place, with the pressure of the vapor in the expansion being less than the first pressure.

The compressor G is illustrated as being driven by an electric motor G-1 that is powered with electricity from the generator 154. The compressor G withdraws vapor from the expansion tank F through a conduit 34 and discharges it through a conduit 36 into a confined space 38 in compression tank H at a pressure greater than the first pressure. The vapor as it is compressed and discharged into confined space 38 is heated. High pressure liquid B-1 is now discharging through expansion orifice 68 into the preheater 70, where the liquid expands to high pressure vapor B-2.

The heat of vaporization for the transformation of high pressure vapor B-1 to high pressure vapor B-2 in preheater 70 is withdrawn from low pressure vapor B-3 in confined space 38, and the temperature of the low pressure vapor is lowered below the first temperature, with consequent transformation of the low pressure vapor to low pressure liquid B-4. The low pressure liquid B-4 flows by gravity into the expansion tank F. High pressure vapor B-2 that has been preheated by absorbing heat from low pressure vapor B-3 in confined space 38, flows through conduit 72 to boiler E where it is super heated and discharged through conduit 24 to confined space 78 to again be recycled through the closed path above described.

The motor actuated mechanism 52 actuates the valve assembly U to sequentially discharge low pressure liquid B-4 into the liquid collector tank J. The low pressure liquid B-4 in collector tank J is super heated and transformed to high pressure liquid B-1 by fluid C flowing through the confined space 20. The operation of valve 65 is controlled by the sensor 66. When the pressure of high pressure vapor B-2 drops below a predetermined magnitude, the valve 65 opens automatically to permit heated high pressure liquid B-1 to discharge through orifice 68 until the pressure of vapor in confined space 78 reaches a desired magnitude.

As the pistons 105 reciprocate as above-described, the crankshaft 72 is rotated. Rotation of crankshaft 72, results in concurrent rotation of shaft 140, and the cams 158 on shaft 140 sequentially operating the actuators 160 to move the ring-shaped valve members 120 between the first and second positions shown in FIGS. 4 and 6.

Rotation of shaft 140 also results in rotation of tubular valve member 130 to permit each of the pistons 105 in succession to move in a power stroke from the right hand end of a cylinder 108 to the left hand end thereof as viewed in FIG. 1. The compression tank H, expansion tank F, liquid collector tank J, and boiler G are preferably disposed at decreasing elevations relative to one another as shown in FIG. 1, to permit flow of liquid B by gravity therebetween. Oil entrained with the vapor B is conducted by conduits 200 and 202 to the separator 28.

In FIG. 9 it will be seen that the electric generator 154 supplies electric power to two conductors 200 and 202, which electric power may be used for any desired purpose. A portion of this electric power flows through conductors 200*a* and 202*a* to energize an electric motor 204 that drives compressor 156. Also, a portion of the electric power flows through conductors 200*b* and 202*b* to energize an electric motor 206 that drives mechanism 52.

The use and operation of the invention has been described previously in detail and need not be repeated.

What is claimed is:

1. In combination with a quantity of a volatile liquid that has a vapor that liquifies when subjected to a first temperature substantially below the temperature of the ambient atmosphere and a first pressure and a source of heat, a rotary power producing assembly that is actuated by energy from said source of heat as said liquid is recycled through a closed path to be sequentially transformed to high pressure vapor, low pressure vapor, low pressure liquid and high pressure liquid, said rotary power producing assembly including:

a. rotary power producing means that is driven when said high pressure vapor flows thereto and low pressure vapor discharges therefrom at a pressure less than that of said first pressure;

b. first, second and third heat exchange means, said first heat exchange means having a high pressure vapor inlet and outlet, said second heat exchange means having a low pressure liquid inlet and high pressure liquid outlet, said third heat exchange means having a high pressure vapor inlet and outlet, a low pressure liquid outlet, and a vapor inlet;

c. an expansion tank having a low pressure vapor inlet, a low pressure liquid inlet, and a low pressure liquid outlet;

d. first means for heating said first and second heat exchange means from said source of heat, said heat in said first heat exchanger super heating said high pressure vapor therein and said heat in said second heat exchanger transforming low pressure liquid therein to high pressure liquid;

e. a first conduit for conducting said super heated high pressure vapor from said outlet of said first heat exchange means to said rotary power producing means and a second conduit for conducting low pressure vapor from said rotary power producing means to said expansion tank where said low pressure vapor expands adiabatically and is cooled;

f. a power driven compressor means for withdrawing said low pressure vapor from said expansion tank and discharging the same into said third heat exchange means at a pressure greater than said first pressure and at a temperature greater than said first temperature;

g. an expansion valve assembly that receives heated high pressure liquid from said outlet in said second heat exchange means and discharges the same into said third heat exchange means to transform to high pressure vapor, with the heat of vaporization for said transformation and the preheating of said high pressure vapor being withdrawn from low pressure vapor in said third heat exchange means to the extent the temperature of said low pressure vapor drops below said first temperature and said low pressure vapor liquifies;

h. a third conduit that connects said low pressure liquid outlet of said third heat exchange means to said low pressure liquid inlet of said expansion tank to permit low pressure liquid to flow from said third heat exchange means to said expansion tank;

i. a fourth conduit that connects said high pressure vapor outlet of said third heat exchange means to said high pressure vapor inlet of said first heat exchange means; and j. associated first valve and conduit means for conducting low pressure liquid from said low pressure liquid outlet of said expansion tank to said low pressure liquid inlet of said second heat exchanger.

2. A rotary power producing assembly as defined in claim 1 in which said source of heat is a stream of fluid containing heat energy, and said first means being first and second passages defined in said first and second heat exchange means through which said stream flows successively to super heat said high pressure vapor in said first heat exchange means and heat said low pressure liquid in said second heat exchange means to transform said low pressure liquid to high pressure liquid.

3. A rotary power producing assembly as defined in claim 1 which in addition includes:

k. an electric generator driven by said rotary power producing means, said generator transforming said rotary power to electric energy.

4. A rotary power producing assembly as defined in claim 3 which in addition includes:

l. a first electric motor for driving said power driven compressor; and m. first electrical conducting means for energizing said first motor with a portion of the electric power produced by said electric generator.

5. A rotary power producing assembly as defined in claim 4 which in addition includes:

n. a second electric motor for sequentially opening and closing said first valve means; and m. second electrical conducting means for energizing said second motor with a portion of the electric power produced by said electric generator.

6. A rotary power generating assembly as defined in claim 3 in which said electric generator emits heat as it operates and said power generating assembly in addition including:

l. a fifth conduit in the form of a coil that encircles said generator, with a first end of said coil connected to said fourth conduit and a second end of said fifth conduit connected to said first conduit to permit high pressure vapor flowing through said fifth conduit to be super heated by said heat emitted from said generator prior to said high pressure vapor being discharged to said rotary power producing means.

7. A rotary power producing assembly as defined in claim 1 in which said rotary power producing means includes:

l. a crankshaft assembly that includes a crankshaft that has first and second end portions and at least one throw intermediate said end portions, a connecting rod pivotally connected to each of said throws, a piston for each of said connecting rod, each piston having first and second end surfaces, and connecting means on each of said first end surfaces for pivotally connecting said piston to said connecting rod associated therewith;

m. a frame assembly that rotatably supports said crankshaft, said frame assembly including a cylinder for each of said pistons in which the latter reciprocate when said crankshaft rotates, each of said cylinders having first and second open ends, and at least one first port in each of said cylinders adjacent said first end thereof;

n. a pressure vessel that defines a confined space, said pressure vessel supporting said frame assembly within said confined space, said pressure vessel having a first opening therein in communication with said first conduit, a second opening in said pressure vessel spaced from said first opening, and a third opening in said pressure vessel through which said second end portion of said crankshaft projects to supply rotary power;

n. a rotary seal supported in said third opening that engages said second end portion of said crankshaft;

o. an elongate tube in said confined space in sealing engagement with said first end of each of said cylinders and in sealing engagement with said second opening, said tube having a second transverse port therein for each of said cylinders, with said second opening in communication with said second conduit;

p. an elongate tubular valve member rotatably supported in said tube, said tubular valve member having a first sealed end and a second open end, said tubular valve member intermediate said first and second ends having a third port therein for each of said second ports, and each of the sets of said second and third ports capable of being brought into registry as said tubular valve member is rotated;

q. second movable valve means on each of said cylinders, each of said movable valve means when in a first position obstructing communication between said confined space in said pressure vessel and said first port and in a second position establishing communication between said confined space in said pressure vessel and said first port;

r. second means that are actuated by rotation of said crankshaft for rotating said tubular valve member and moving said second valve means in such timed relationship that as each of said pistons moves from said first end of said cylinder in which it is slidably movable to a second end thereof, said second and third ports associated with that particular cylinder are out of registry with one another and said second movable valve means on said cylinder is in said second position to establish communication between said confined space in said pressure vessel and said first port to permit high pressure vapor in said confined space in said pressure vessel to flow into said cylinder to exert an equal and opposite force on said first end surface of said piston to that force exerted by said high pressure vapor in said confined space on said second end surface of said piston, and said second means upon one of said pistons having moved to said second end of said cylinder with which it is associated and starting to reverse the movement thereof rotating said tubular valve member to the extent that second and third ports therein are in communication and said second valve means moving to said first position to obstruct communication between said first port and said confined space in said pressure vessel, with said high pressure vapor in said confined space of said pressure vessel exerting a force on said second end surface of said piston to move the latter from said second end of said cylinder towards said first end thereof to rotate said crankshaft, with said high pressure vapor in said confined space in said pressure vessel as each of said pistons moves from said second end of said cylinder towards said first end of said cylinder expanding and being cooled as a result thereof to a temperature higher than said first temperature.

8. A rotary power producing assembly as defined in claim 7 in which said crankshaft has a plurality of throws thereon that are movably engaged by a plurality of said connection rods that are connected to a plurality of said connecting means on a plurality of said pistons to reciprocate the latter in sequence in a plurality of cylinders in such timed sequence as to rotate said crankshaft as said second valve means and said tubular valve member move to sequentially allow high pressure vapor in said confined space in said vessel to exert an unbalanced force on said second end surfaces of said pistons.

* * * * *